United States Patent [19]

Tretter

[11] Patent Number: 4,916,277

[45] Date of Patent: Apr. 10, 1990

[54] ALTERNATE ACTION MECHANISM

[75] Inventor: Daniel E. Tretter, Shannon, Ill.

[73] Assignee: Honeywell Inc., Minneapolis, Minn.

[21] Appl. No.: 252,241

[22] Filed: Sep. 29, 1988

[51] Int. Cl.[4] ..... H01H 13/56; H01H 3/42

[52] U.S. Cl. ..... 200/524; 200/409; 200/430; 200/318.1; 200/322

[58] Field of Search ..... 200/408, 409, 430, 318, 200/523, 524, 318.1, 341, 293, 332.1, 332

[56] References Cited

U.S. PATENT DOCUMENTS

| | | | |
|---|---|---|---|
| 2,956,446 | 10/1960 | Ensign et al. | 73/503 |
| 3,688,060 | 8/1972 | Risk | 200/409 |
| 3,691,333 | 9/1972 | Elliott | 200/526 |
| 3,697,713 | 10/1972 | Ohkita | 200/524 |
| 3,809,837 | 5/1974 | Yoshida | 200/332 X |
| 3,821,534 | 6/1974 | Mehner et al. | 200/338 |
| 3,824,362 | 7/1974 | Bury | 200/524 |
| 3,962,556 | 6/1976 | Kravchuck | 200/5 R |
| 4,001,526 | 1/1977 | Olson | 200/16 D |
| 4,072,841 | 2/1978 | Corfield | 200/332 |
| 4,161,637 | 7/1979 | Priesemuth | 200/524 |
| 4,218,598 | 8/1980 | Iwasaki et al. | 200/524 |
| 4,354,074 | 10/1982 | Aurand et al. | 200/524 |
| 4,417,115 | 11/1983 | Desmaris et al. | 200/524 X |
| 4,482,791 | 11/1984 | Rendgen | 200/343 |
| 4,543,459 | 9/1985 | Hayashida | 200/524 X |
| 4,559,426 | 12/1985 | Van Zeeland et al. | 200/524 X |

FOREIGN PATENT DOCUMENTS

| | | | |
|---|---|---|---|
| 2373863 | 7/1978 | France . | |
| 536357 | 5/1941 | United Kingdom | 200/409 |
| 850104 | 9/1960 | United Kingdom | 200/409 |

*Primary Examiner*—Ernest G. Cusick
*Attorney, Agent, or Firm*—Charles L. Rubow

[57] ABSTRACT

An alternate action mechanism having a housing with first and second transverse walls enclosing a snap-acting switch accessible through a hole in the first wall. An actuator includes a plunger disposed in the hole for operating the switch and a guide structure slidable along the exterior surface of the second wall. A cam formed on the second wall cooperates with a follower carried by the guide structure to alternately retain the plunger in and release it from a depressed position upon successive depressions.

10 Claims, 2 Drawing Sheets

ALTERNATE ACTION MECHANISM

BACKGROUND OF THE INVENTION

The invention disclosed herein relates generally to linear motion mechanisms of the type in which successive operations of an actuator alternately cause the plunger to be latched at and released from a latched position and, more particularly, to an alternate action mechanism design which may be readily incorporated into the design of conventional miniature momentary action switches.

Switches of this type commonly include a plunger for switch operation which extends from the snap-acting mechanism through the housing. The plunger is depressed to operate the mechanism as a momentary switch and the plunger is biased away from the depressed position. Such switches are presently in wide use in both mechanical actuation and manual actuation applications. Applicant's invention is directed toward using the present snap-acting mechanism and only modifying the present molded plastic housing. The added features obtainable while continuing the use of presently manufactured elements indicate that applicant's invention may be implemented in a cost-effective and efficient manner.

SUMMARY OF THE INVENTION

The present invention provides an alternate action mechanism for use with a switching element located in a chamber enclosed in part by mutually transverse first and second walls. The switching element is accessible through a hole through the first wall.

An actuator, including a plunger disposed in the hole for engaging the switching element, is mounted for sliding movement along the external surface of the second wall between an extended position and a depressed position. The actuator includes guide structure extending along the exterior surface of the second wall. An element on the external surface of the second wall cooperates with an element carried by the actuator to alternately retain the actuator in the depressed position and release the actuator from the depressed position on successive depressions of the actuator.

DESCRIPTION OF THE PREFERRED EMBODIMENTS

Figure 1:
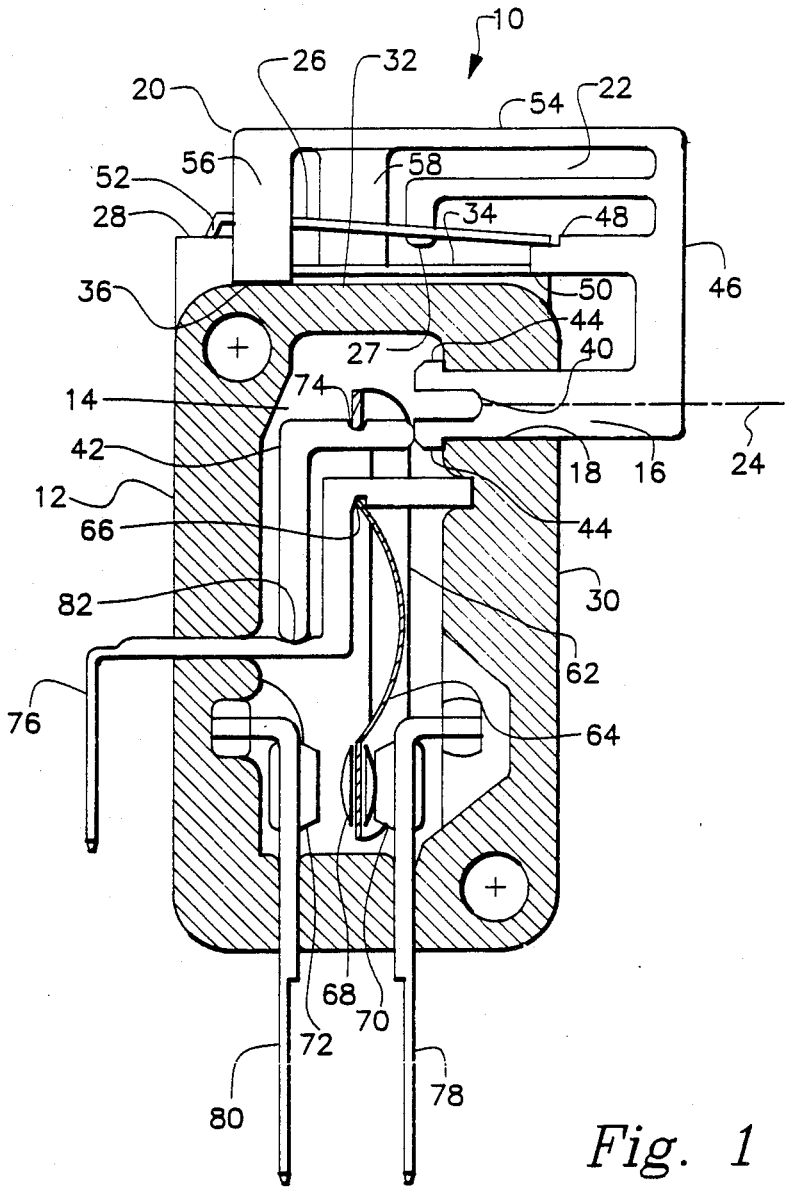
FIG. 1 is a side view of a snap-acting switch incorporating the alternate action mechanism in accordance with the present invention. A cover of the switch housing has been removed to show the plunger and snap-acting switch.
Figure 2:
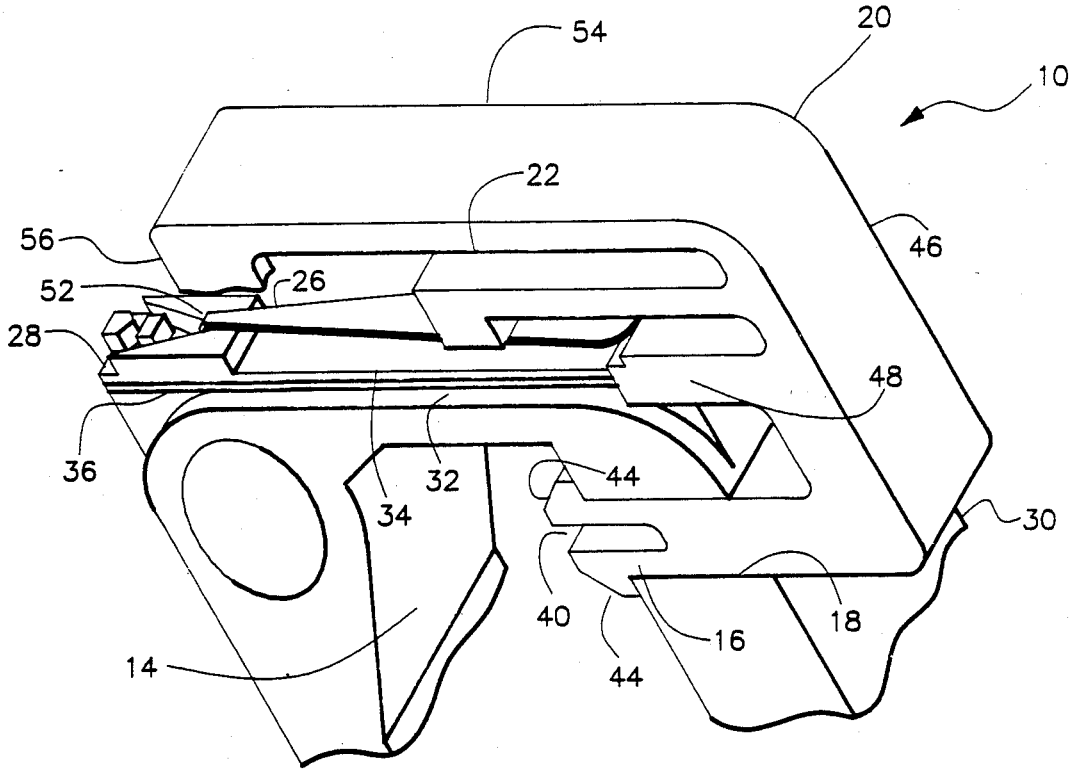
FIG. 2 is a perspective view of the actuator in place on the switch housing. The housing cover has been removed, and the snap-acting switch is not shown.
Figure 3:
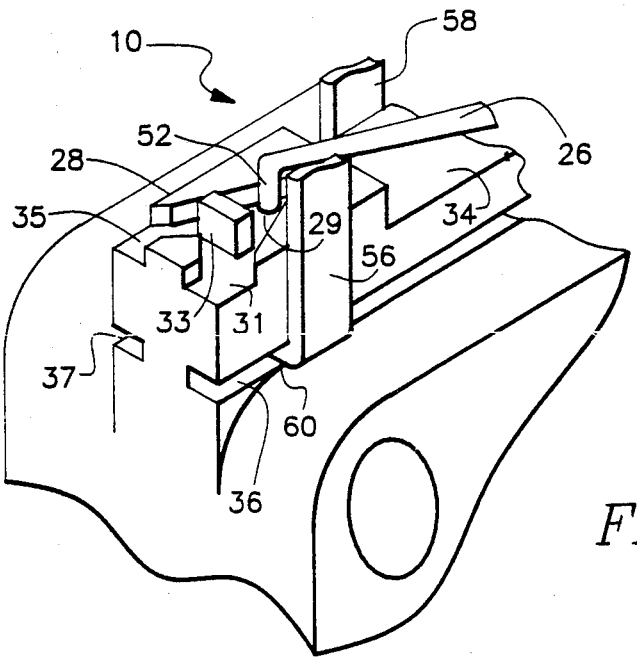
FIG. 3 is an enlarged partial perspective view of the actuator partially broken away to more clearly show a cam formed on the housing and depending legs of the actuator.

In FIGS. 1–3, reference numeral 10 identifies an alternate action mechanism in accordance with the applicant's invention incorporated into a miniature snap-acting switch of conventional design. The embodiment shown includes a housing 12 surrounding a chamber 14 which contains a snap-acting switch mechanism. Plunger 16 which is part of actuator 20, extends through hole 18 in first housing wall 30 for operation of the snap-acting switch mechanism. The snap-acting switch biases plunger 16 toward the outside of housing 12. An actuator 20 which generally includes plunger 16 and a guide structure 22 is movably mounted on housing 12 for movement parallel to axis 24 of hole 18. A cam follower 26 carried by the actuator cooperates with a cam 28 formed on housing 12 to provide the alternate action.

Housing 12 includes a first wall 30 and a second wall 32 transverse to first wall 30. A guide 34 is formed on second wall 32 and extends parallel to axis 24. Guide 34 includes grooves 36 and 37. Cam 28 is formed on second wall 32 and is a cardioid multilevel cam. A cardioid multilevel cam is described in U.S. Pat. No. 4,354,074, entitled Alternate Action Mechanism, and the patent is assigned to the same assignee as the present invention.

Actuator 20, including the plunger 16, is movable relative to housing 12 between a first position in which plunger 16 is extended outside the housing and a second position with plunger 16 depressed into housing 12. Plunger 16 includes flanges 44 to limit plunger travel outside the housing. Notch 40 allows flanges 44 to collapse to permit plunger top-loading into hole 18. The snap-acting switch biases the plunger away from the depressed position.

Guide structure 22 of actuator 20 includes an actuator upright 46 attached to plunger 16. Guide structure 22 also includes a slide 48 which extends from actuator upright 46. Lower surface 50 of slide 48 is shaped to fit guide 34 for ease of sliding movement. Surface 50 may include a shape to straddle guide 34 to prevent sideways movement of actuator 20 relative to guide 34.

Guide structure 22 further includes an upper member 54 which extends generally over and is spaced from housing second wall 32. Upper member 54 has depending legs or spacers 56 and 58 which engage second wall 32 to maintain the sliding movement of actuator 20 parallel to axis 24 and to prevent sideways wobbling of the actuator. Legs 56 and 58 further include curved ends or hooks, such as hook 60, for engaging grooves 36 and 37 in guide 34. The hooks help to maintain actuator movement parallel to axis 24 of hole 18 and to further stabilize actuator 20 during movement.

Actuator 20 carries cam follower 26 which may be of a resilient metallic material. Cam follower 26 has a first end 52 which engages cam 28 to provide latching of actuator 20 to maintain plunger 16 in the depressed position. Cam follower 26 is pivotably mounted to actuator 20 at reference numeral 27 to allow lateral movement of the first end when it is following cam 28. Follower 26 abuts slide 48 and moves laterally to axis 24 when follower 26 pivots at 27.

The snap-acting switch, while not part of the present invention, will be described to facilitate understanding of the present invention.

The snap-acting switch includes a snap-acting element 62, lever 42, a spring 64, a pivot member 66, a movable contact 68, a normally closed contact 70, and a normally open contact 72.

Snap-acting element 62 as shown in FIG. 1 has a central opening which allows it to move with lever 42, pivot member 66, and spring 54 extending through the central opening. One end of the central opening of the snap-acting element serves as a pivot point 74 between lever 42 and element 62. Snap-acting element 62 has an end of spring 64 and movable contacts 68 secured thereto. Spring 62 is always in compression with the spring force acting through snap-acting element 62 and through pivot point 74 to bias lever 42 against plunger 16 so that actuator 20 is biased toward the undepressed position.

Electrical continuity is provided from movable contact 68 through spring 64 and pivot member 66 to a common switch terminal 76. Normally closed contact 70 is electrically connected to a switch terminal 78, and normally open contact 72 is electrically connected to a switch terminal 80.

Operation may be described by assuming that snap-acting element 62 is in a first position with plunger 16 undepressed, cam follower 26 is positioned in area 29 against a wall of cam 28, and movable contact 68 is engaged with normally closed contact 70.

Actuator 20 may then be moved along second wall 32 in a direction to depress plunger 16. Moving actuator 20 to depress plunger 16 will cause lever 42 which is pivoted at 74 and 82 to move away from first wall 30 and cam follower first end 52 to move along cam 28. Lever 42 will exert force on snap-acting element 62 at 74 and move element 62 away from first wall 30. As pivot point 74 is moved beyond a plane formed by the end of snap-acting element 62 which carries movable contact 68 and the pivot point of spring 64 against spring pivot member 66, the stored energy of spring 64 will cause movable contact 68 to snap into contact with normally open contact 72. Continued movement of actuator 20 in the same direction will position follower first end 52 in area 31. Upon release of actuator 20, cam follower first end 52 will come to rest against wall 33 of cam 28, and plunger 16 will be latched in the depressed or second position. Subsequent movement of actuator 20 beyond the depressed position will move follower first end 52 into area 35 of cam 28 and will release or unlatch actuator 20. Releasing actuator 20 will allow follower 52 to follow cam 28 on a different path than the path followed during the depression of plunger 16 with follower first end 52 eventually coming to rest in area 29 against a wall of cam 28. Plunger 16 will then have been returned to its original undepressed position.

In accordance with the foregoing description, applicant has developed a simple alternate action mechanism that is easily incorporated into the design of conventional momentary action switches.

Although a specific embodiment of the applicant's mechanism is shown and described for illustrative purposes, a number of variations and modifications will be apparent to those of ordinary skill in the relevant arts. It is not intended that coverage be limited to the disclosed embodiment, but only by the terms of the following claims.

The embodiments of the invention in which an exclusive property or right is claimed are defined as follows:

1. An alternate action mechanism comprising:

a housing having an interior chamber enclosed in part by mutually transverse first and second walls, the first wall having a hole therethrough extending along an axis, the second wall having an exterior surface thereon;

a switching element located in said chamber, at least a portion of said element being movable along the axis between first and second positions respectively nearer to and further from the first wall, said element being biased toward the first position;

an actuator having a plunger slidably disposed in said hole along the axis thereof, said plunger engaging said switching element, said actuator further having a first member extending along the external surface of the second wall;

means for engaging the first member of said actuator with said housing second wall so as to maintain linear sliding movement of said actuator along a direction parallel with the axis of said hole between extended and depressed positions; and means including cooperating elements on said actuator and on the exterior surface of the second wall for alternately retaining the actuator in the depressed position and releasing the actuator from the depressed position on successive depressions of said actuator.

2. The mechanism of claim 1 wherein said means for engaging the first member of said actuator with said housing second wall comprises:

a slide formed on said actuator;

a guide formed on said exterior surface of said second wall, said guide having a shape for sliding receipt of said slide; and a depending leg on a portion of the first member of said actuator, said leg having an end which slidably engages said second wall, said leg being configured to maintain a predetermined spacing of said portion of the first member of said actuator from said second wall.

3. The mechanism of claim 2 wherein:

said guide has at least one groove generally parallel to the axis of said hole;

said depending leg has a hook formed on the end thereof adapted to fit into said at least one groove to slidably secure said leg to said guide while maintaining a spaced relationship between said first member and said guide.

4. In an alternate action mechanism of the type having a housing with transverse first and second walls at least partially surrounding a switching element controlled by an actuator including a plunger extending along an axis through a hole in the first wall, the plunger being movable along the axis between released and depressed positions and biased toward the released position, the second wall having an exterior surface thereon, the alternate action mechanism further including latching means operable upon successive depressions of the plunger beyond the depressed position to alternately latch the plunger at and release the plunger from the depressed position, the improvement which comprises:

guide structure extending along the exterior surface of said second wall, said guide structure being configured to maintain linear movement of said actuator relative to said housing; and cooperating elements on said guide structure and on the exterior surface of said second wall for alternately retaining said actuator in the depressed position and releasing said actuator from the depressed position upon successive depressions thereof.

5. The mechanism of claim 4 wherein said latching means comprises:

a cam formed on the exterior surface of said second wall; and a resilient cam follower carried by the guide structure of said actuator, said cam follower cooperating with said cam to alternately latch said actuator in the depressed position and release said actuator from the depressed position upon successive depressions of said actuator.

6. The mechanism of claim 5 wherein said resilient cam follower is pivoted on said guide structure to allow an end of said cam follower which engages said cam to move in a direction transverse to the axis of the hole.

7. The mechanism of claim 5 wherein:

a guide is formed on said second wall, said guide extending in a direction generally parallel to the axis of said plunger;

a slide is formed on the guide structure of said actuator, said slide being adapted for sliding engagement with the guide;

the guide structure of said actuator includes a first member extending substantially parallel to said axis and spaced from said second wall, said first member having at least one transverse leg extending toward said second wall; and means for slidably securing the end of said at least one transverse leg to said second wall.

8. The mechanism of claim 7 wherein said means for slidably securing the end of said at least one transverse leg to said second wall, comprises:

at least one groove in said guide, said at least one groove extending generally parallel to the axis; and a hook formed on the end of said at least one transverse leg and adapted to fit into said at least one groove to slidably secure said at least one transverse leg to said guide while maintaining a spaced relationship between said first member and said second wall.

9. The mechanism of claim 7 wherein said slide is configured to straddle said guide to prevent sideways movement of said slide relative to said guide.

10. The mechanism of claim 9 wherein said means for slidably securing the end of said at least one leg to said second wall, comprises:

at least one groove in said guide, said at least one groove extending generally parallel to the axis; and a hook formed on the end of said at least one leg and adapted to fit into said at least one groove to slidably secure said at least one leg to said guide while maintaining a spaced relationship between said first member and said second wall.

* * * * *